US006766751B2

(12) United States Patent
Liu

(10) Patent No.: US 6,766,751 B2
(45) Date of Patent: Jul. 27, 2004

(54) INTEGRATED WASTE CONTAINMENT AND PROCESSING SYSTEM

(75) Inventor: Samuel Y. K. Liu, Honolulu, HI (US)

(73) Assignee: Asia Pacific Environmental Technology, Inc., Honolulu, HI (US)

( * ) Notice: Subject to any disclaimer, the term of this patent is extended or adjusted under 35 U.S.C. 154(b) by 49 days.

(21) Appl. No.: 10/060,568

(22) Filed: Jan. 29, 2002

(65) Prior Publication Data

US 2003/0140828 A1 Jul. 31, 2003

(51) Int. Cl.[7] ..... F23B 7/00
(52) U.S. Cl. ..... 110/341
(58) Field of Search ..... 110/341, 346; 700/215, 223, 224; 220/371, 745, 747

(56) References Cited

U.S. PATENT DOCUMENTS 3,639,728 A * 2/1972 Helfand et al. ..... 235/61.11
4,958,578 A * 9/1990 Houser ..... 110/246
5,111,938 A * 5/1992 Soprano et al. ..... 206/386
5,385,105 A * 1/1995 Withers et al. ..... 110/346
5,666,891 A 9/1997 Titus et al. ..... 110/250
5,707,508 A 1/1998 Surma et al. ..... 205/688
5,729,464 A * 3/1998 Dimitri ..... 364/478.03
5,756,957 A 5/1998 Titus et al. ..... 219/121.38
5,785,923 A 7/1998 Surma et al. ..... 266/144
5,798,497 A 8/1998 Titus et al. ..... 219/121.37
5,811,752 A 9/1998 Titus et al. ..... 219/121.27
5,831,859 A * 11/1998 Medeiros et al. ..... 364/478.06
5,847,353 A 12/1998 Titus et al. ..... 219/121.36
5,908,564 A 6/1999 Titus et al. ..... 219/121.36
6,018,471 A 1/2000 Titus et al. ..... 363/126
6,037,560 A 3/2000 Titus et al. ..... 219/121.37
6,049,560 A 4/2000 Freeman ..... 373/142
6,206,055 B1 * 3/2001 Hollub et al. ..... 141/98

* cited by examiner

*Primary Examiner*—Kenneth B. Rinehart
(74) *Attorney, Agent, or Firm*—Lewis Brisbois Bisgaard & Smith LLP; William C. Steffin; David N. Makous

(57) ABSTRACT

Disclosed is an integrated and streamlined system and method for collecting, containing and processing different types of wastes which provides an economically efficient solution of treating wastes and utilizing the collected data in an operationally useful manner either or both of the waste generator and processor. The present system and method include waste containment in compliance of the laws and governmental regulations, and processing of the wastes. In one embodiment, the system and method also includes compilation and utilization of data relating to the collected and processed wastes.

12 Claims, 8 Drawing Sheets

INTEGRATED WASTE CONTAINMENT AND PROCESSING SYSTEM

BACKGROUND OF THE INVENTION

1. Field of the Invention

This invention relates to an integrated system of collecting, containing, transferring, and processing wastes, which is economically efficient and environmentally friendly. In one embodiment, the integrated waste containment and processing system of the present invention also includes compiling, analyzing and ultimately utilizing data relating to the collection and processing of the wastes that are useful and beneficial to either or both of the waste generator and processor.

2. Background

Traditionally, landfills and incinerators are used to dispose of solid wastes. Both of these systems, however, have many limitations and problems. In addition to space limitations, there is increased public concern about gaseous emissions from hazardous and municipal landfills and the possibility of contamination of groundwater. The production of large quantities of gaseous emissions from incinerator systems could also result in the need for costly air pollution control systems in an attempt to decrease emissions levels to comply with requirements imposed by regulatory agencies. The potential for leaching of medical, infectious wastes including pathogenic agents to the environment also poses a significant threat to the general public safety. It was therefore desirable to develop a medical/infectious waste disposal system and process which could insure substantial elimination of the possibility of the medical/infectious waste being leached to the environment, and which could be used in the medical/infectious waste treatment industry in a practical, safe and economically efficient manner.

To overcome the problems associated with landfills and incinerators, attempts have been made to utilize plasma arcs to destroy toxic wastes. Such systems are disclosed, for example, in U.S. Pat. Nos. 5,280,757, 4,644,877, and 4,431,612, the disclosures of which are incorporated herein by this reference. There has been also developed a waste converting system that uses combinations of independently controllable plasma arcs and joule-heating in a melter. Such systems, also known as PEM (Plasma Enhanced Melters), are generally disclosed in U.S. Pat. No. 6,037,560 and its related family of patents, the disclosures of which are incorporated herein by this reference.

While both the plasma arc systems and PEM systems provide certain advantages over the traditional waste disposal systems such as landfills or incinerators, e.g., having the ability to convert wastes to useful syngas and other recyclable products, there existed a need for further improvement. While technological aspects of the PEM system have been described and developed, prior to the invention disclosed and claimed herein, there was no integrated waste collection and disposal working process which could offer the plasma arc or PEM systems to the waste generators and processors as an efficient, safe and economically feasible system of waste disposal. In addition, there was no existing waste disposal system that complies with the laws and regulations that govern the collection and disposal of medical/infectious wastes. For example, despite existing regulations, medical/infectious wastes are currently being processed without using containers that meet the required specifications of U.S. Department of Transportation (DOT) and the United Nations.

It was therefore desirable to have an integrated waste collection and processing system and process which is efficient, cost effective, and compliant with governmental regulations to enable both the waste generators and processors to utilize useful waste disposal systems such as the PEM system.

BRIEF SUMMARY OF THE INVENTION

The process of the present invention relates to an integrated and streamlined system and method for collecting, containing and processing different types of wastes including solid and hazardous, asbestos, medical/infectious, pharmaceutical, radioactive, crematory and Other Potentially Infectious Material (OPIM) wastes, etc. The integrated waste containment and processing system of the present invention includes up to three major components: (1) waste collection and containment; (2) treatment and processing of the wastes; and, in one embodiment; (3) collection, compilation and utilization of data relating to the collected wastes and the processing of the waste. The combination of these components provides an economically efficient solution for collecting and treating wastes and in some embodiments, utilizes selected portions of the collected data in an operationally useful manner both for the waste generator and processor.

First, the present system provides a method of collecting and containing the wastes in accordance with the regulatory governmental requirements and also in a practical and economically feasible manner which was not achieved in the art prior to the present inventions. Specially designed containers are provided at the waste generation sites to allow for convenient and efficient, collection and initial containment of the waste. According to the invention, these containers are designed to meet or exceed the specifications required by the United States government, DOT, and the United Nations for containing and transporting certain types of waste collected. The containers are provided to the waste generators with pre-classified designations that indicate the appropriate types of wastes to be placed in the containers. The containers are designed to meet quality specifications to minimize, and, ideally, substantially eliminate leakage of any component of the waste to the environment. As an added precaution, in one embodiment, the transportation vehicles are also equipped with a containment section which is designed to substantially prevent any leakage of any component of the waste, e.g. a sub micron filtered exhaust that creates a negative pressure within the containment section when it is closed.

In addition to the containment system, the present invention provides an optimal way of treating and disposing of wastes. In one embodiment, the wastes are processed to produce syngas, vitrified glass and metal materials. The syngas, one of the end products of the processing of the waste, may contain carbon monoxide, carbon dioxide, hydrogen, methane and other light hydrocarbons in various concentrations depending on the compositions of the waste and operating parameters of the disposal equipment, and may be utilized as a fuel to operate the disposal equipment, process other wastes or generate electricity for internal use or sale to the power grid.

Another embodiment of the invention provides for the collection and utilization of data relating to the wastes which enhances the safety, efficiency and practice of the waste containment and processing system and method of the invention. One aspect of the data collection process deals with tracking the wastes. From the point the empty containers are delivered to the waste generators, each of the containers is tracked so that selected information about its location, content, waste treatment status, and even the end products acquired from the waste can be readily accessed. The tracking system ensures that each and every waste container is properly received from the generator, transported and timely processed.

Another aspect of the data collection is to compile relevant information about the processed wastes, e.g., the type, source, volume, composition, mass balance and frequency, and to analyze and acquire statistically meaningful trends and correlations that are useful to both the waste generator and processor. The waste processor may, for example, develop an optimal waste-operating recipe based on the specific type and composition of the wastes. In one embodiment, the optimal waste-operating recipe may allow utilizing the waste itself as a fuel for processing the waste disposal system. The waste generator may also use the collected and analyzed data and correlate them with other relevant business parameters to make its operation more efficient and less expensive.

The integrated waste containment and processing system and process of the present invention streamlines the entire process of collecting and processing the wastes, and, in one embodiment, allows for compiling and extrapolating relevant data relating to the wastes that are meaningful and helpful to both the waste generator and processor.

Other systems, methods, features and advantages of the invention will be or will become apparent to one of skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. In the figures, like reference numerals designate corresponding parts or steps throughout the different views and figures.

DETAILED DESCRIPTION OF THE PREFERRED EMBODIMENTS

This description is not to be taken in a limiting sense, but is made for the purpose of illustrating the general principles of the invention. The section titles and overall organization of the present detailed description are for the purpose of convenience only and are not intended to limit the present invention.

Figure 1:
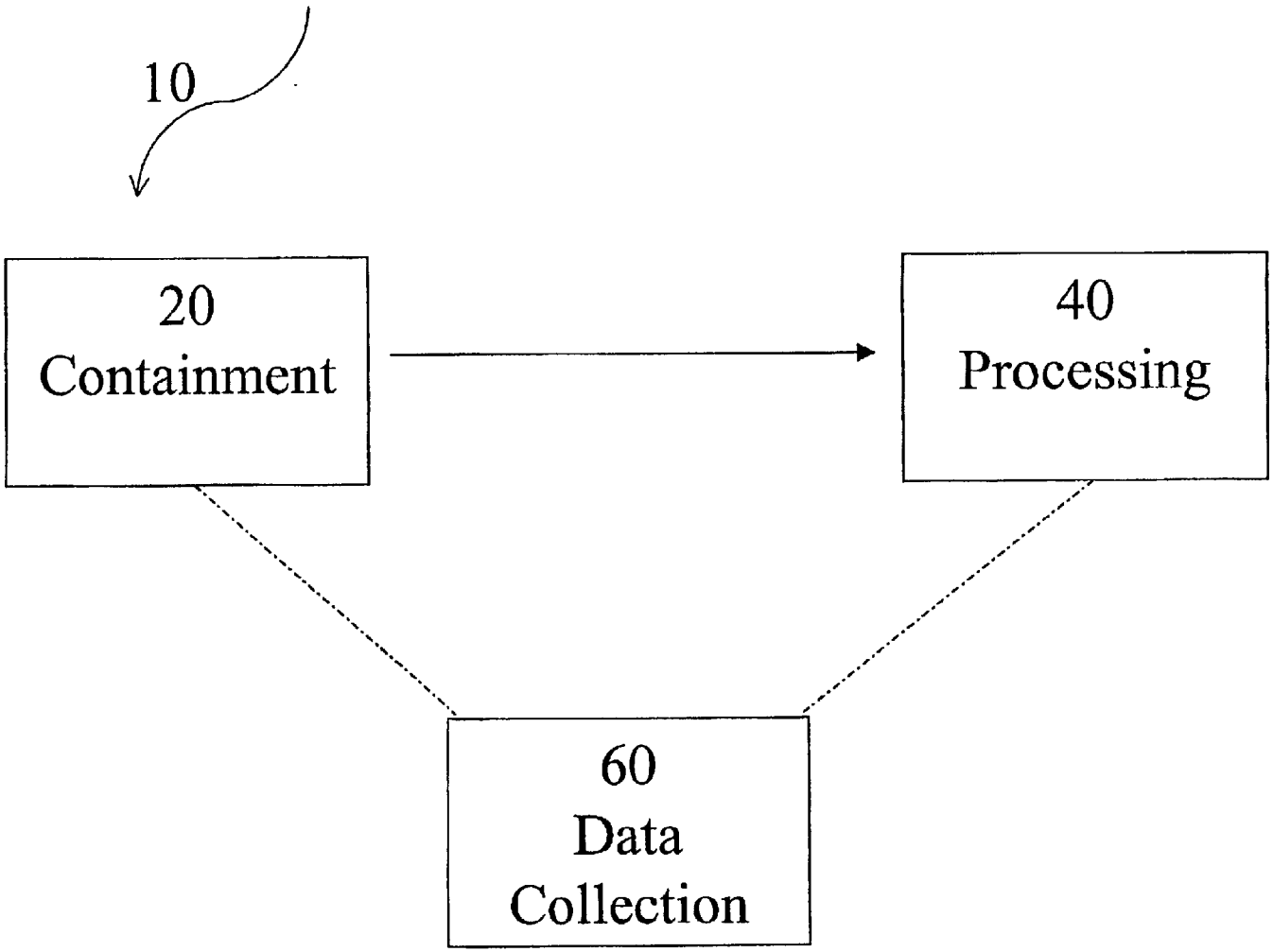
FIG. 1 is a diagram depicting the overall containment and processing system according to one embodiment of the present invention.

The chart in FIG. 1 provides an overview of the integrated waste containment and processing process 10 according to one embodiment of the present invention. As shown in FIG. 1, that process has two major elements—a containment step 20 and a processing step 40. The containment step 20 generally refers to collection and transportation of wastes from a waste generator site to a processing site while the processing step 40 generally includes treatment of collected wastes and recycling, further use or safe disposal of end-products of the processing step. In another embodiment of the present invention, data collection step 60 is an additional component to make the functions of the containment step 20 and the processing step 40 more safe, efficient, practical and useful. The data collection step 60 generally encompasses waste tracking, and compilation and utilization of information concerning the wastes and end products. As indicated by dotted lines in FIG. 1, in one embodiment, the data collection step 60 may take place during both the containment 20 and the processing 40 steps. Each of these steps of the process of the present, invention is discussed in more detail hereinafter.

Figure 2:
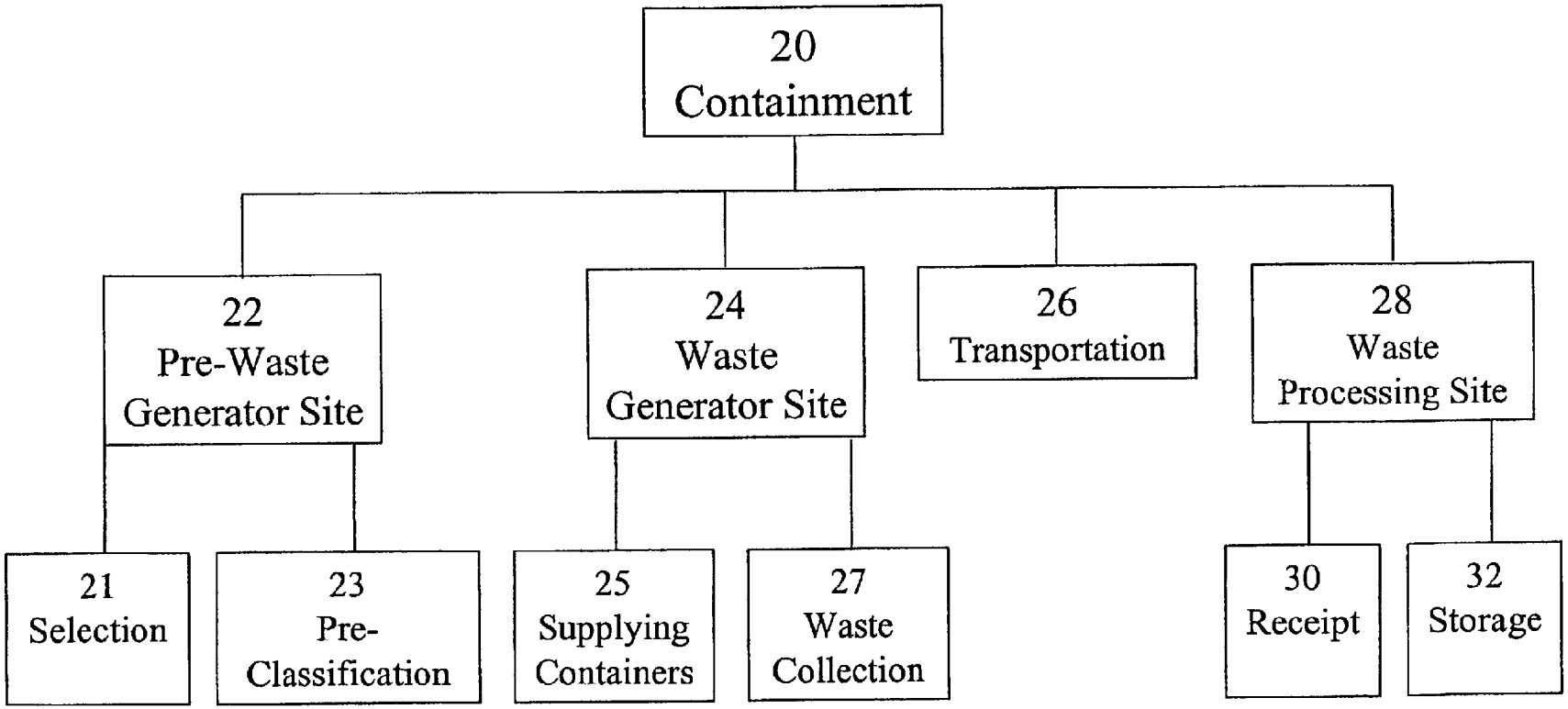
FIG. 2 is a diagram illustrating the containment element according to one embodiment of the present invention.

FIG. 2 provides a diagram illustrating different components of the containment step 20 according to one embodiment of the present invention. As shown in FIG. 2, the containment step 20 begins with selecting and classifying appropriate waste containers 29 at a pre-waste generator site 22. Appropriate types and sizes of containers 29 are determined and selected 21 at this stage. Using information provided by the waste generator as well as historic information, as experience with a waste generator or specific waste stream increases, specific data relating to that generator can be used to refine the process at site 22.

The present invention encompasses the collection, treatment, disposal and/or destruction of various types of wastes including, but not limited to, solid and hazardous, asbestos, medical/infectious, pharmaceutical, radioactive, crematory and OPIM wastes.

Solid waste includes any discarded material, including, but not limited to, Municipal Solid Waste (MSW), as defined by the Environmental Protection Agency (EPA) in 40 CFR Part 261 which is incorporated herein by this reference. Municipal waste generally refers to the waste collected by municipalities for disposal. It includes, without limitation, garbage, food residues, yard trimmings, and sludge formed in sewage treatment.

Hazardous waste includes solid waste that exhibits hazards of ignitibility, corrosivity, reactivity and/or toxicity, including, but not limited to, hazardous waste defined in 40 CFR Part 261, wastes defined in Subpart C, and listed wastes due to characteristics of hazards and acute or toxic properties defined in Subpart D. (Each subject is incorporated herein by this reference.) Hazardous waste may contain, without limitation, industrial chemicals such as halogenated fluorocarbons, dioxins, asbestos, polychlorinated biphenyls, and vinyl chloride. Asbestos waste includes, without limitation, asbestos containing materials described in the Toxic Substance Control Act (TSCA) and defined in 40 CFR Part 763 (incorporates herein by this reference).

Medical/infectious waste includes, without limitation, any waste generated in the diagnosis, treatment, or immunization of human beings or animals, in research pertaining thereto, or in the production or testing of biologicals (40 CFR Part 62). Medical/infectious waste includes, without limitation, infectious substances, diagnostic specimens, biological products and regulated medical waste defined by the DOT in 49 CFR §173.134. An infectious substance is any viable microorganism, or its toxin that causes or may cause disease in humans, animals or plants, and any agent that causes or may cause severe, disabling or fatal disease. Medical/infectious waste includes, without limitation, regulated wastes under the Occupational Safety and Health Administration (OSHA) blood borne pathological standard (29 CFR §1910.1030) and biohazardous waste such as pathogenic agents. The references in this paragraph are incorporated herein by this reference.

Pharmaceutical waste includes, without limitation, expired and/or unused medications and/or waste from the production and testing of pharmaceuticals. Radioactive waste generally refers to material containing the unusable radioactive by-products of the scientific, military, medical and industrial applications of nuclear energy. Crematory waste includes, without limitation, residual waste from the cremation of corpses, blood, and preserved specimens.

OPIM waste includes, but is not limited to: human body fluids; unfixed tissue or organs; HIV-containing cell or tissue cultures, organ cultures, HIV- or HBV-containing culture medium or other solutions; and blood, organs, or other tissues from experimental animals infected with HIV or HBV. OPIM waste includes, but is not limited to, those wastes defined under the blood borne pathogen regulation 29 CFR 1910.1030, incorporated herein by this reference.

For each of these wastes, it is desirable to ensure that the containers are designed and made to adequately hold the particular wastes without leakage or spillage to the environment. Particularly, for the medical/infectious waste, 49 CFR §§107 and 173 provide that failure to ship regulated medical waste in approved DOT containers may subject the producer and transporter of medical waste to civil penalties, injunctions, punitive damages and felony criminal prosecution. Yet, prior to the present invention, there was no existing integrated waste collection and processing process which offered a practical and economically feasible way to collect and transport the medical/infectious waste in compliance with these regulatory requirements. As a result, almost all medical/infectious waste in the United States is presently transported in violations of those regulations.

The containers selected according to the present invention are also preferably rigid, substantially airtight, water resistant and puncture resistant, and may be equipped with a safety tamper resistant latched lid. Depending on the wastes to be transported, the containers may be made from recycled plastic materials. Further, it is within the scope of the inventions to design the containers to be suitable to collect and transport biohazardous wastes and infectious agents such as agents that are suspected to cause anthrax, small pox, tuberculosis, etc.

Once appropriate containers are selected at step 21, these containers may be pre-classified in step 23. Such pre-classification may be based on the types of the wastes or combination of wastes to be held, i.e. medical, municipal, hazardous, radioactive, etc. Sub-classification within one type of the waste can also be made. For example, different types, size or color containers may be used for each of the different types of medical/infectious wastes—pathological, biohazardous or chemotherapeutic. Other differentiation methodologies readily apparent to those skilled in the art are within the scope of the invention. Pathological waste means, without limitation, waste material consisting of human or animal remains, anatomical parts, and/or tissue, the bag/containers used to collect and transport the waste material and animal bedding. Pathological wastes may include any type of human or animal tissue, such as placentas or amputated limbs. Biohazardous wastes may include anything that has been contaminated with human or animal blood, or fluids including "sharps" like needles, syringes, and blades. Finally, chemotherapeutic waste means, without limitation, waste material resulting from the production or use of antineoplastic agents used for the purpose of stopping retarding or reversing the growth of malignant cells. Chemotherapeutic wastes may include the residual material generated during chemotherapy treatment including tubing, IV bags and syringes.

The pre-classified containers are next provided to the waste generator site 24 e.g., hospitals as depicted by step 25. Collection step 27 of appropriate wastes for the containers then takes place. In one embodiment, designated trained personnel from the waste generator and/or waste processor supervise the entire process of collecting wastes and securing the containers, e.g., with a tamper resistant latch, prior to pick up. As a further step, such designated personnel may label/mark each container as to its contents. An element of the containment step 20 in some embodiments of the invention is to establish and trace the chain of custody. For example, upon release of the container to the waste processor, a shipping label as well as a Chain of Custody Form may be completed at each pick up by both the waste generator and processor.

After collecting the waste at the waste generator site 24, in one embodiment, transportation 26 takes place. A specially equipped transportation vehicle 31 having a containment section 33 may be used to reduce or prevent any atmospheric, liquid or solid leakage or spillage of the wastes or its contents, e.g., airborne pathogens. The containment section 33 of the transportation vehicle 31 may maintain a sub micron filtered exhaust 34 which when the containment section 33 is secured shut creates a pressure that is negative to the atmospheric pressure thereby substantially limiting leakage from any spills or vapor leaks within the vehicle box. It Is to be understood that the containment section 33 described herein may be constructed utilizing other methods well known in the art which can maintain negative pressure with other purification systems. Also, emergency lighting and roadway lights can be "on" all the time for high visibility, safety, and special night operations lighting. Further, brackets and/or a safety rail 35 may be provided within the containment section 33 of the transportation vehicle 31 to safely secure the waste containers 29. To properly respond to an emergency or spill, each transportation vehicle 31 is preferably provided with an infectious or hazardous safety kit and also trained personnel to address such an emergency.

It is to be understood that the transportation step 26 is described generally to demonstrate the safe and effective transportation of sealed waste from the generator site to the processing site. It is within the scope of the invention to include different transportation steps adapted to particular generator/processing systems. For example, with a large waste generator such as a large hospital complex, economics may justify an onsite-processing site. In that circumstance, the transportation step could comprise any convenient system of moving the filled, sealed waste containers to the processing unit, such as via pallets or conveyer belt or the like. Such on site transportation systems are within the scope of the invention.

Next, upon arrival at a waste processing site 28, the waste containers are received at a designated place within the site 28, and in one embodiment, may pass through a metal detector, an x-ray machine and/or a radiation monitor to insure, for example, that no unwanted radioactive elements are included in medical/infectious waste containers. It is to be understood that when a radioactive waste is to be collected and processed, it is desirable to insure that no other types of waste is mixed with the radioactive waste throughout the process of the collection and treatment of the waste unless the site is designed to process radioactive waste. After receipt at the waste processing site 28 but prior to actual treatment and processing of the wastes, the containers may be stored in a proper location to insure continuing containment of the wastes. In one embodiment, the waste containers are stored in a refrigerated 20-foot gated room or Container. The storage room is locked and secured so that only authorized personnel will gain access. The room may also, in one embodiment, be subjected to a pressure that is negative to the atmospheric pressure.

The containment step 20 described above comprises providing the waste containers with pre-classified designations, and collecting and transporting the waste containers in a manner that complies with the regulatory standards and insures against any significant leakages of waste component to the environment. The containment step 20 of the present invention thus provides a safe, efficient, and economically viable method for the waste generators and processors to collect and transport the wastes to the waste processing site.

Figure 3:
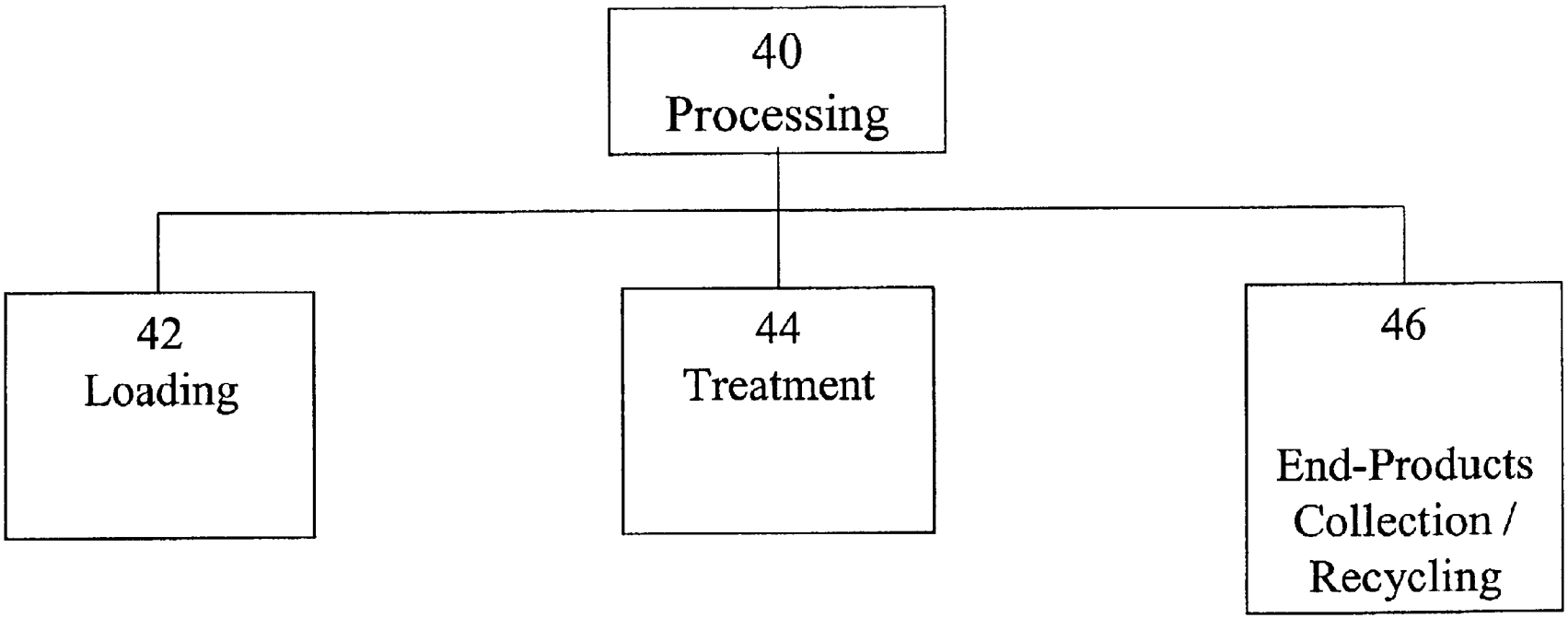
FIG. 3 is a diagram illustrating the waste processing element according to one embodiment of the present invention.

In addition to the containment step 20 described above, the present invention provides an economically efficient and environmentally friendly way of treating and disposing of wastes. As illustrated in FIG. 3, at the processing step 40, the waste is preferably treated and disposed of by utilizing a system that is capable of substantially eliminating leachable solids or the exhaustion of hazardous gases into the atmosphere, e.g., the PEM system that utilizes plasma arc and joule heaters as described in the patents referenced above. The PEM system also transforms the waste into useful syngas, and stable, non-leachable solid-vitrified glass and metal-end-products. The PEM system can convert the organic portion of the waste into a useful hydrogen-rich gas while converting the inorganic portion of the waste into a vitreous glass-like material and metal end-products which are recyclable or reusable.

In one embodiment, the processing step 40 comprises three sub-elements: loading step 42, treatment step 44, and end-products collection/recycling step 46. Preferably, all wastes are treated and recycled on the day of receipt at the waste processing site 28. The loading step 42 comprises placing the waste containers 29 on a conveyor belt 41 which moves the containers 29 to the waste disposal system 43, e.g., the PEM unit. In one embodiment, the containers 29 are moved in the following sequence: (1) First, the containers 29 travel along the horizontal section 45 of the conveyor belt 41 which is, in one embodiment, about 125-foot long; (2) Next, the containers 29 are raised approximately 15 feet by an elevator mechanism 47 (3) Then, the containers 29 move onto a roller conveyor system 48; and (4) Finally, each container 29 is automatically picked up by a mechanical system 49 and fed into the PEM unit.

After the waste is properly treated, the end-products of the waste treatment may be collected. For the PEM system 47, the end-products include hydrogen-rich gas, glass and metal materials as described above. The syngas produced may be used as a fuel to process other wastes in the PEM system. Substantially, all carbon containing components in the waste are converted to syngas components or elemental carbon. The syngas may be used for on-site electricity generation in, for example, fuel cells, reciprocating engines, or gas turbines. The vitrified glass end products may be used to form useful commercial products 82 such as roofing tiles, insulating panels and other construction-related products and for the generation of sandblasting mediums. The metal end-products may also be remelted and processed to create useful alloys. If the solid end products are not used to form any commercial products, the solid end products may instead be disposed without risk to the environment since they are safe and stable. The phrase "end-products" used herein thus includes the useful syngas as well as the stable, non-leachable solid glass and metal materials that are recovered from the waste processing step 40.

Collection and recycling of these solid end-products may advantageously be accompanied by routine sampling and testing to evaluate their safety and suitability for use. In one embodiment, chemical testing on these solid end-products are performed in accordance with the EPA's Toxicity Characteristic Leaching Procedure (TCLP). The test results are evaluated against the limits published by the EPA, and only end-products that fall within the acceptance test result limits are used for a commercial product. If the solid end-products are not to be used for a commercial product, the solid end-products are properly disposed. Even though the solid end-products are safe and stable, as an added precaution, the solid end-products that are not to be used for a commercial product may be stored in appropriate containers that will not cause leachate to be released nor cause any other health or safety hazard.

Figure 4:
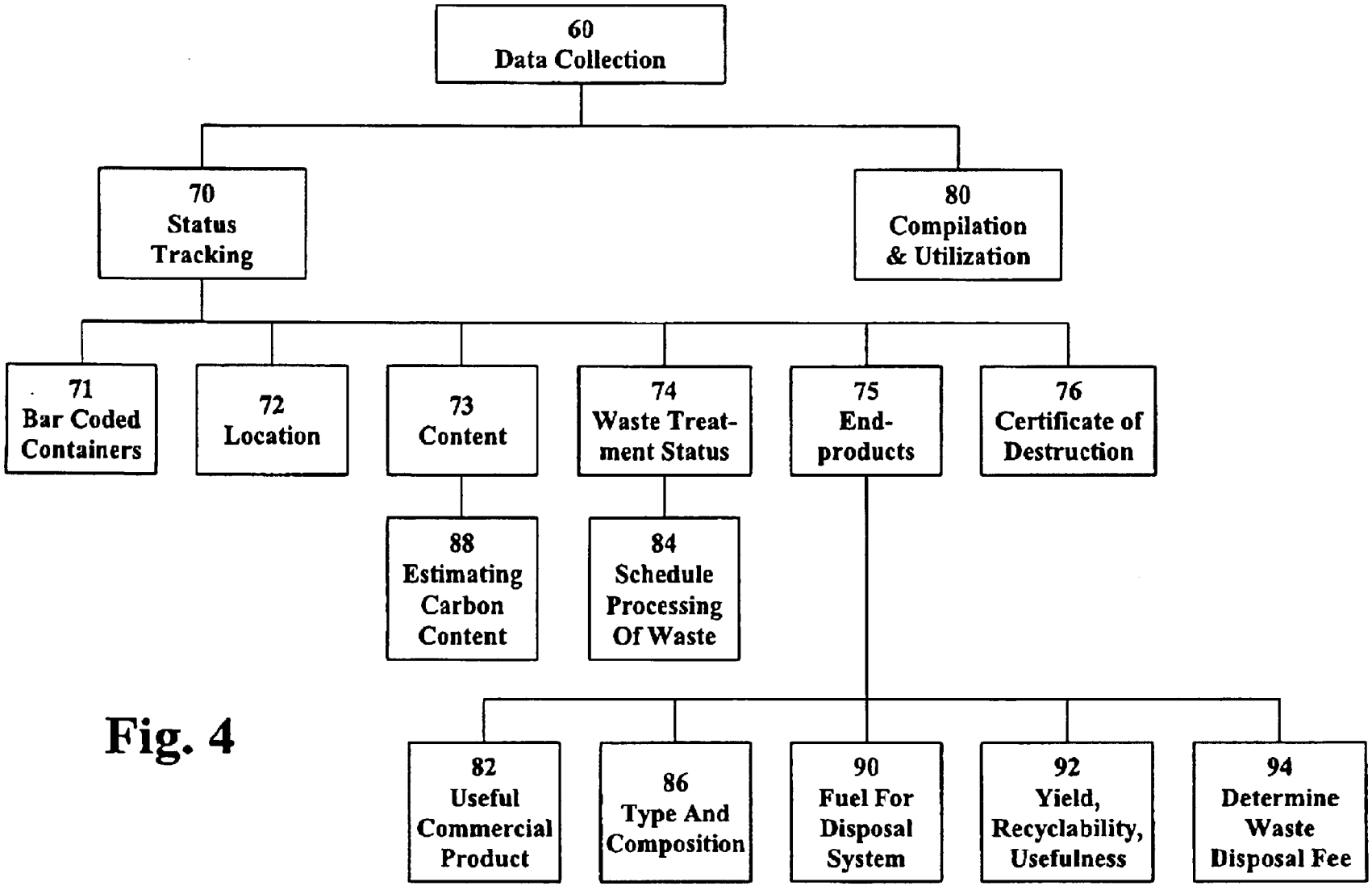
FIG. 4 is a diagram illustrating the data collection element according to one embodiment of the present invention.
Figure 5:
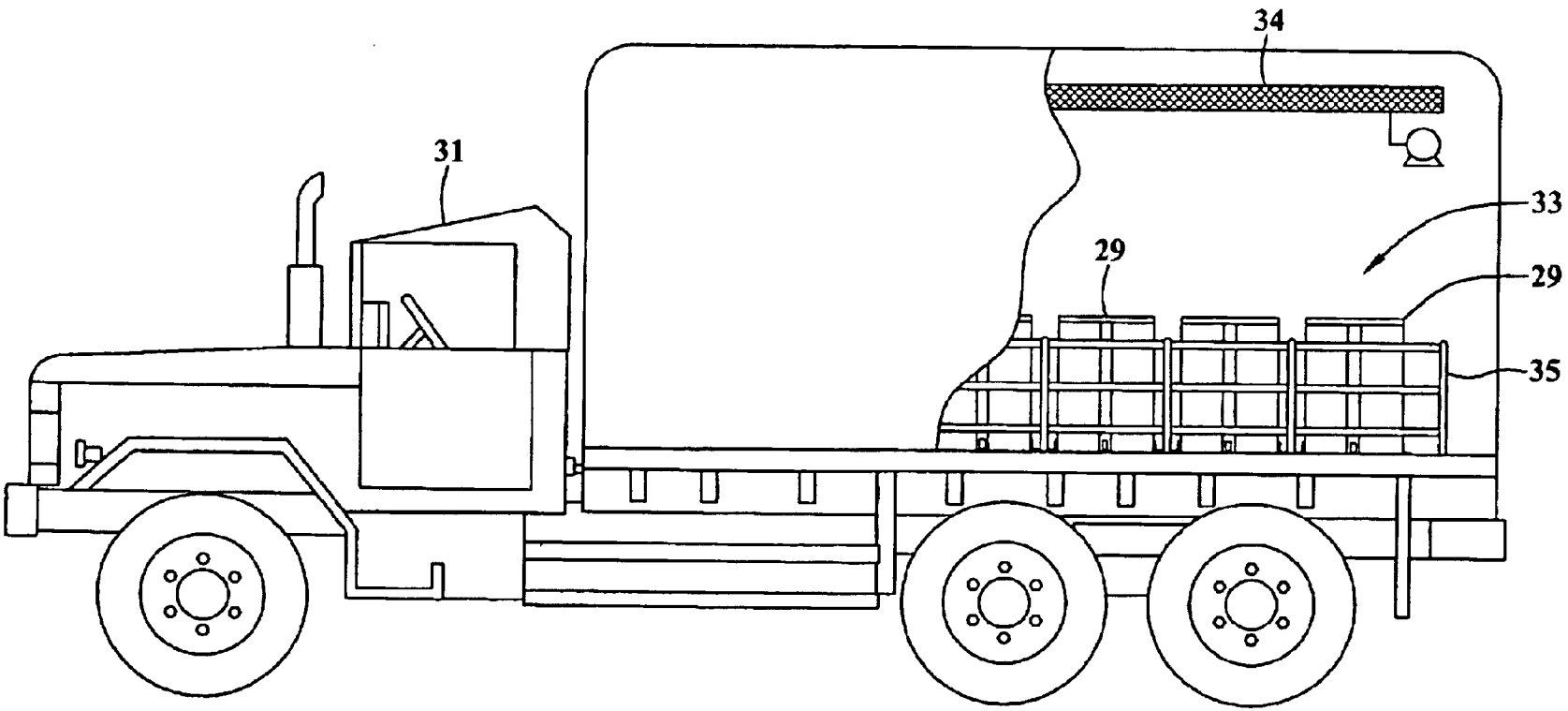
FIG. 5 is a side elevation, partially cutaway, of a transportation vehicle having a containment section including a sub-micron filter exhaust and a safety rail for safely transporting a plurality of waste containers to a waste processing site.
Figure 6:
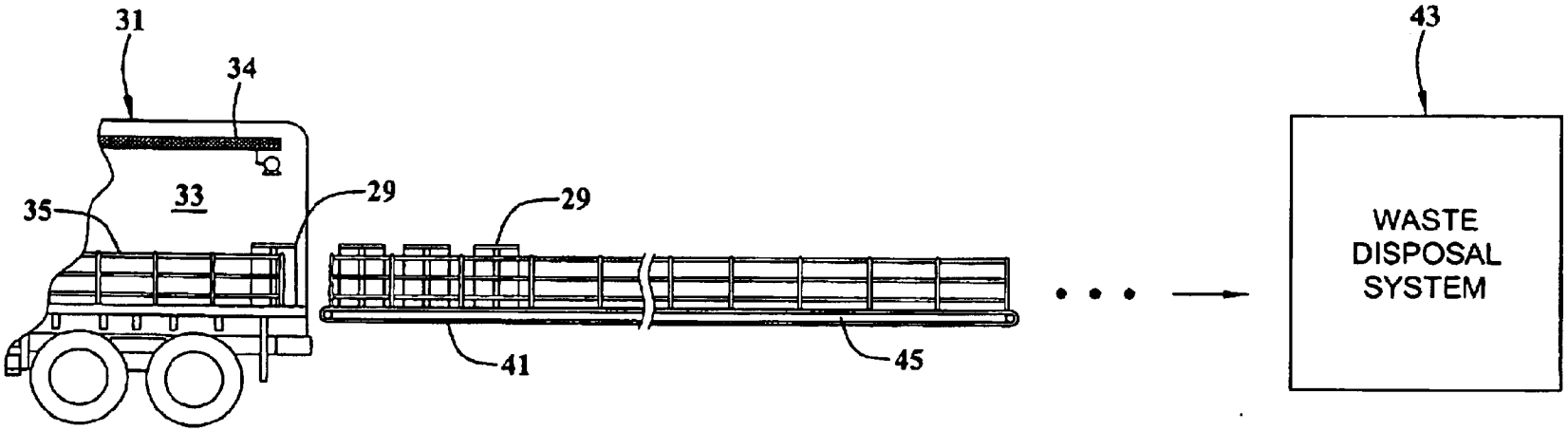
FIG. 6 is a fragmented side elevation of the rear end of the transportation vehicle of FIG. 5 showing the waste containers being loaded onto a horizontal section of a conveyor belt for delivery to a waste disposal system.
Figure 7:
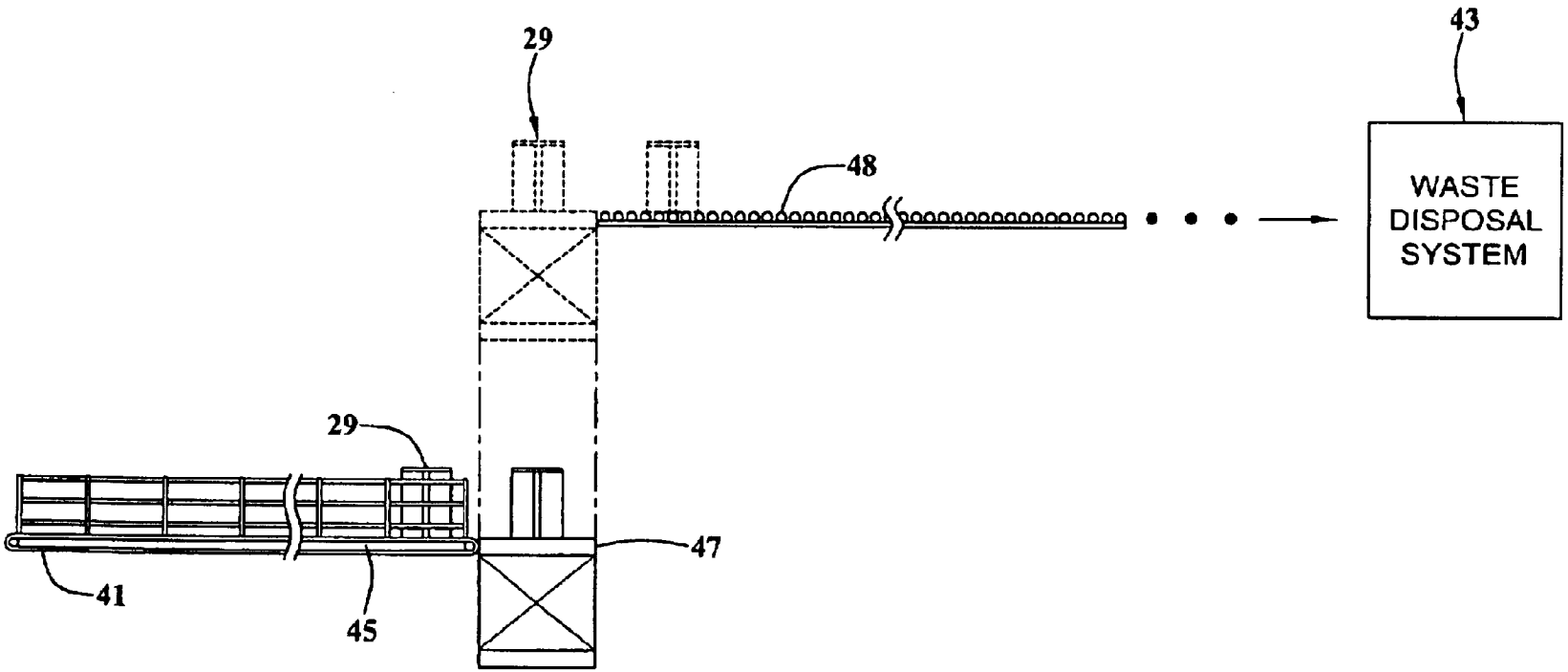
FIG. 7 is a fragmented side elevation of the processing system showing the waste containers being transported by the horizontal section of the conveyor belt, an elevator mechanism, and a roller conveyor system towards the waste disposal system.
Figure 8:
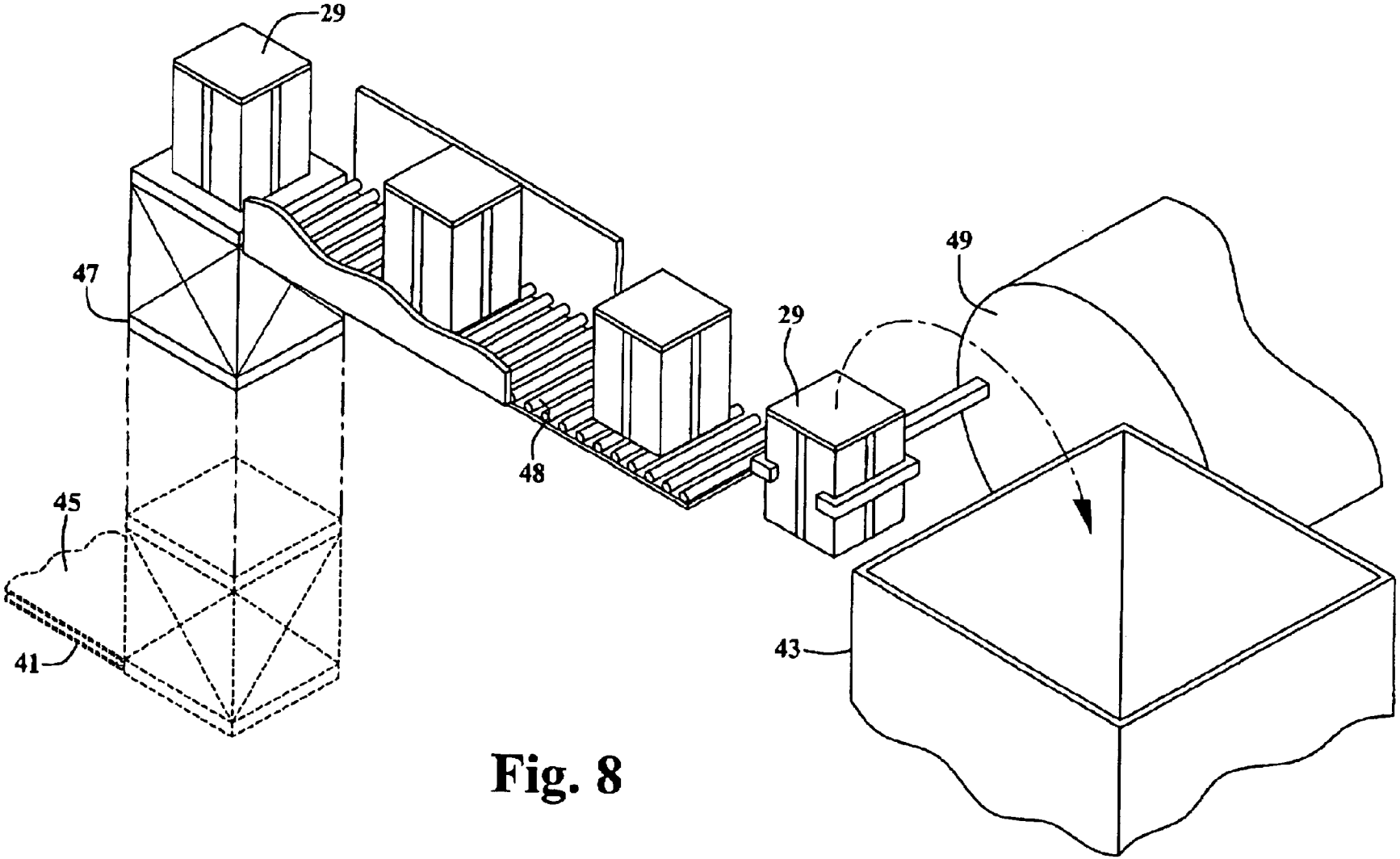
FIG. 8 is a perspective view of the processing system showing the waste containers being transported across the conveyor belt and up the elevator mechanism, across the roller conveyor system, and being emptied via a mechanical system into the waste disposal system.

In other embodiments of the present invention, collection and utilization of the data relating to the waste play a role in making both the waste containment and processing more safe, efficient, and practical. As illustrated in FIG. 4, data collection step 60 encompasses two major concepts—status tracking 70 and data compilation and utilization 80.

The waste is tracked throughout the waste collection, transportation and treatment process. The status tracking 70 begins with selecting and providing appropriate waste containers to a waste generator. Each container may be given a unique identity such as bar coding or electronic identification. While the process will be described in terms of bar coding, any means of uniquely identifying the container known in the art or later developed is within the scope of the invention.

In the example described herein, bar coded waste containers 71 are used to provide a unique identifier associated with each waste container. The term "bar codes" refers to the generally known coding system such as the Universal Product Code (UPC) that uses a printed pattern of lines and bars to identify selected information such as products, customer account and other relevant information. From the delivery of the empty waste containers to the waste generators, each of the containers may be tracked using the bar code system so that information about its location 72, content 73, waste treatment status 74, and the end-products 75 acquired from the waste can be readily accessed.

The status information may be made available at all or any stages of the waste collection and processing to both the waste generator and processor. Information scanned from the bar coded containers may be sent to one or more distance locations. For example, information about the waste can be almost instantaneously sent to either or both the waste generator, i.e. hospitals, and processor sites. In this manner, the waste generator and processor can both access, process, and monitor the data and information regarding each waste container, and communicate with each other about any particular needs with respect to pick up, transportation, storage, and processing of the waste. Alternatively, the information may be gathered at different stages and later transmitted to a central data base, depending on the needs of a specific system.

The waste status information and the chain of custody of each waste container may be generally updated and monitored in the following manner. Initially, when a waste container is delivered to a waste generator, the empty container is scanned and drop off information are entered. The drop off information may include, for example and without limitation: date and time of the drop off; container number, size, type and color; customer or waste generator number; drop off location; number of containers provided; and the employee numbers for both the waste generator and processor personnel involved.

The next information update may take place at the time of pick up of the waste container. Container pick up information collected may be sent to both the waste generator and processor. The pick up information may include, for example and without limitation: date and time of the pick up; waste container number; customer number; weight and content of the waste; and location of the pick up and employee identifications of those involved.

The pick up information sent to the waste processor may be used to prepare and schedule receipt, storage and treatment of the waste in an organized and efficient manner. Once the containers are received at the processing site, the following information, for example and without limitation, may be collected and updated: date and time of the receipt; receiver employer number; storage location within the processing site; the type, content and weight of the waste; and scheduled processing date/time. Further, each of the waste containers may be scanned immediately prior to being processed and information about the completion of processing may be automatically updated.

The status tracking 70 of the present invention thus makes it possible if desired to access and confirm the status of each waste container 29 from the point of drop-off and pick-up to complete processing of the waste, and to plan and schedule for treatment 84 of the waste, thereby fostering an efficient use of the waste disposal system 43. In one embodiment, the status tracking 70 goes one step further and includes the step of collecting and tracking information regarding any end-products to generated from the waste such as the end-products' content, weight, testing status and results and whether the end-products can be used or recycled.

Further, the status tracking 70 of the present invention makes it possible to capture the life history of the waste from the point of collection to complete disposal and recycling, and to provide a report which summarizes such history. In one embodiment of the present invention, for each container or each batch of containers, a "Certificate of Destruction" 76 or similar document is issued to the waste generator which may include all relevant information about the waste including, for example but not limited to: the waste content, type, weight; date and time of pick up and destruction; pick up and destruction location; and content of end-products and status. The "Certificate of Destruction" may be issued, in one embodiment, by the particular type or group of the waste which has been collected and disposed of, e.g. the life history of certain biohazardous sharps or pathological body parts may be separately tracked and a respective "Certificate of Destruction" may be issued for each type of the waste.

The "Certificate of Destruction" 76 not only certifies proper destruction of the waste, but also eliminates "cradle-to-grave" liability that is often associated with the existing waste disposal systems. The "Certificate of Destruction" 76 provides a complete traceability of the waste and insures that the waste is properly disposed of without incurring any future potential harm to the environment—water, air or soil or future liability to the waste generator or processor. The "Certificate of Destruction" 76 thus eliminates, if not significantly reduces, the liabilities that are often associated with the conventional waste disposal systems—landfills and incinerators—and provides a legitimate basis for lowering the insurance costs for the waste generators.

In addition to the status tracking 70, data and information regarding the waste can be compiled, processed, and analyzed 80 to acquire statistically meaningful and operationally useful trends and correlations for both the waste generator and the processor. This information is already captured through the status tracking 70 process described above. In particular, information about the waste itself such as the type, volume, weight, composition of the waste, time of collection, source/origin of the waste, frequency, type of patient from which the waste is collected, and the end-products' type, yield and usefulness can be compiled and utilized.

Once a sufficient amount of data are complied, the waste processor may analyze and correlate the type, content, volume and/or weight information of the waste to the operating parameters of the waste disposal system 43 such as the PEM unit. In this way, the processor can develop a specific and efficient waste-operating recipe based on the specific type and composition of the waste 86. In one embodiment, products not consisting of waste may be introduced to the system to formulate appropriate recipes to create appropriate end products. In yet another embodiment, by estimating the carbon content 88 of the incoming waste, the waste processor may utilize the waste itself as a fuel 90 to operate the waste disposal system 43, e.g., feed a waste stream with sufficient carbon content to generate enough energy from the end products to operate the waste destruction process.

Information about the end-products' yield and recylability 92 may be correlated to the type and composition of the waste 86, and such information may be relevant in determining and/or adjusting the waste disposal fee 94. For example, if certain wastes provide a valuable revenue stream from their end products, there might be an economic incentive to charge a discounted fee to the waste generators whose wastes produce a high yield of reusable or recyclable end products.

The information compiled and analyzed regarding the waste may also be made available on the Internet or by direct electronic communication in a client specific manner. The waste generators may access the data, and correlate them with other business parameters. The waste generators may also use the compiled information about the waste to achieve a more efficient management and operation. For example, a hospital may predict the type of waste that will be generated based on the specific medical conditions that certain patients have. Patients who will generate same or similar types of medical/infectious waste then can be stationed in a specific section or location within the hospital in order to facilitate a faster, more efficient and cost effective collection and pick up of the waste. Further, the waste generator or the hospital may compile and generate patient specific waste information, and such information may be valuable for both the physicians and the patient to better appraise the medical conditions as well as the treatment history.

Having thus described different embodiments of the invention, other variations and embodiments that do not depart from the spirit of the invention will become readily apparent to those skilled in the art. The scope of the present invention is thus not limited to any one particular embodiment, but is instead set forth in the appended claims and the legal equivalents thereof.

What is claimed is:

1. A process of utilizing an integrated waste containment and processing system, comprising:

selecting and classifying a waste container to collect a specified type of waste;

providing the waste container to a generator of the specified type of waste, the waste container being used to collect the waste;

collecting the specified type of waste in the selected waste containers;

transporting the waste container to a waste processing site utilizing a transportation vehicle having a compartment which maintains a sub micron, filtered exhaust which when secured shut creates a pressure which is negative to the atmospheric pressure insuring against any significant leakage of any component of the waste outside of the compartment;

processing the waste in a waste disposal system, the waste disposal system capable of converting the waste into end-products; and collecting and tracking information about the waste as it moves through the process of utilizing the integrated waste containment and processing system, wherein the information can be electronically accessed from one or more distant locations.

2. The process of claim 1, compartment of the transportation vehicle further comprising brackets and a safety rail to secure the waste container.

3. A process of utilizing an integrated waste containment and processing system, comprising:

selecting and classifying a waste container to collect a specified type of waste;

providing the waste container to a generator of the specified type of waste, the waste container beina used to collect the waste;

collecting the specified type of waste in the selected waste containers;

transporting the waste container to a waste processing site;

processing the waste in a waste disposal system, the waste disposal system capable of converting the waste into end-products;

receiving and storing the waste container in a designated site at the waste processing site;

Loading the waste container utilizing a conveyor belt system wherein the conveyor belt system comprises:

a horizontal section of the conveyor belt;

an elevator to raise the waste container;

a roller belt; and a mechanical system to pick up and feed the waste container into the waste disposal system;

treating the waste; and collecting and testing the end-products; and collecting and tracking information about the waste as it moves through the process of utilizing the integrated waste containment and processing system, wherein the information can be electronically accessed from one or more distant locations.

4. A process of utilizing an integrated waste containment and processing system, comprising:

selecting and classifying a waste container to collect a specified type of waste;

providing the waste container to a generator of the specified type of waste, the waste container being used to collect the waste;

collecting the specified type of waste in the selected waste containers;

transporting the waste container to a waste processing site;

processing the waste in a waste disposal system, the waste disposal system capable of converting the waste into end-products;

collecting and tracking information about the waste as it moves through the process of utilizing the integrated waste containment and processing system, wherein the information can be electronically accessed from one or more distant locations; and utilizing information about the waste to predict an arrival time at the waste processing site which predicted arrival time may be used to schedule processing of the waste containers.

5. A process of collecting and containing a waste, comprising the steps of:

selecting an appropriate container to collect the waste, the container having a unique, identification code;

providing the container to a waste generator;

transporting the container with the collected waste in a vehicle, wherein the vehicle has a containment section designed to substantially eliminate a leakage of any component of the waste outside of the containment section, wherein the containment section of the vehicle is equipped to maintain a sub micron filtered exhaust and which when secured shut in the containment section creates a pressure that is negative to atmospheric pressure; and tracking information about the waste at selected points throughout the process of collecting and containing the waste, wherein the information can be electronically accessed by either or both of the waste generator and a waste processor.

6. A process of collecting, containing, and processing a waste, comprising the steps of:

selecting an appropriate container to collect the waste, the container having a unique identification code;

providing the container to a generator of the waste;

transporting the container with the collected waste in a vehicle, wherein the vehicle has a containment section designed to substantially prevent a leakage of any component of the waste outside of the containment section;

receiving and storing the container at a waste processing site;

loading the container into a waste disposal system utilizing a conveyor belt system having a conveyor belt, wherein the conveyor belt comprises:

a horizontal section of the conveyer belt;

an elevator to raise the waste container;

a roller belt; and a mechanical system to pick up and feed the waste container into the waste disposal system;

treating the waste in a waste disposal system, the waste disposal system capable of converting the waste into end-products; and removing the end-products.

7. A process of collecting, containing, and processing a waste, comprising the steps of:

selecting an appropriate container to collect the waste, the container having a unique identification code;

providing the container to a generator of the waste;

transporting the container with the collected waste in a vehicle, wherein the vehicle has a containment section designed to substantially prevent a leakage of any component of the waste outside of the containment section, wherein the containment section of the vehicle is equipped to maintain a sub micron filtered exhaust, which when in the containment section is secured shut creates a pressure that is negative to the atmospheric pressure;

receiving and storing the container at a waste processing site;

loading the container into a waste disposal system utilizing a conveyor belt system;

treating the waste in a waste disposal system, the waste disposal system capable of converting the waste into end-products; and removing the end-products.

8. A process of compiling and utilizing data relating to a waste stream, comprising:

collecting, transporting, and treating a waste;

collecting information about the waste at selected points as the waste is collected, transported, and treated, wherein the information comprises data relating to the content, origin, or end-products of the waste;

electronically storing and making the information available to either or both a waste processor and a waste generator;

correlating the information to operating parameters of a waste disposal system; and predicting an arrival time of the waste at a waste processor site and scheduling for treatment of the waste.

9. A process of compiling and utilizing data relating to a waste stream, comprising:

collecting, transporting, and treating a waste;

collecting information about the waste at selected points as the waste is collected, transported, and treated, wherein the information comprises data relating to the content, origin, or end-products of the waste;

electronically storing and making the information available to either or both a waste processor and a waste generator;

correlating the information to operating parameters of a waste disposal system; and correlating and estimating the carbon content of the waste based on a specific type and composition of the waste; and utilizing the waste as a fuel for a waste disposal system.

10. A process of compiling and utilizing data relating to a waste stream, comprising:

collecting, transporting, and treating a waste;

collecting information about the waste at selected points as the waste is collected, transported, and treated, wherein the information comprises data relating to the content, origin, or end-products of the waste;

electronically strong and making the information available to either or both a waste processor and a waste generator;

correlating the information to operating parameters of a waste disposal system; and collecting data relating to the end-products generated from the specific type and composition of the waste; and determining or adjusting a waste disposal fee for the waste.

11. The process of claim 10, wherein the data relating to the end-products include information about yield and whether the end-products are useable to form a commercial product.

12. A process of utilizing an integrated waste containment and processing system, comprising:

selecting and classifying a waste container to collect a specified type of waste; providing the waste container to a generator of the specified type of waste, the waste container being used to collect said waste;

collecting the specified type of waste in the selected waste containers;

transporting the waste container to a waste processing site;

processing the waste in a waste disposal system, the waste disposal system capable of converting the waste into end-products;

collecting and testing the end-products;

collecting and tracking information about the waste at selected points as it moves through the process of utilizing the integrated waste containment and processing system, wherein the information can be electronically accessed from one or more distant locations, and wherein the information comprises drop off, pick up, and processing information;

providing a certificate of destruction to the generator, wherein the certificate provides positive confirmation of the destruction of the waste; and utilizing information about the waste to predict an arrival time at the waste processing site which predicted arrival time may be used to schedule processing of the waste containers.

* * * * *